US005592713A

United States Patent [19]

Rones

[11] Patent Number: 5,592,713

[45] Date of Patent: Jan. 14, 1997

[54] TOILET MOP

[75] Inventor: James M. Rones, Atlanta, Ga.

[73] Assignee: Americo, Acworth, Ga.

[21] Appl. No.: 617,116

[22] Filed: Mar. 18, 1996

[51] Int. Cl.[6] ..... A47K 11/10

[52] U.S. Cl. ..... 15/210.1; 15/104.94

[58] Field of Search ..... 15/104.94, 208, 15/209.1, 210.1, 228

[56] References Cited

U.S. PATENT DOCUMENTS

| | | | |
|---|---|---|---|
| 2,233,831 | 3/1941 | Burke | 15/210.1 |
| 2,703,424 | 3/1955 | Nicoli | 15/228 |
| 2,719,315 | 10/1955 | Sheehan | 15/210.1 |
| 2,816,313 | 12/1957 | Beck et al. | 15/210.1 |

FOREIGN PATENT DOCUMENTS

| | | | |
|---|---|---|---|
| 2645188 | 4/1978 | Germany | 15/210.1 |
| 710555 | 6/1954 | United Kingdom | 15/210.1 |

*Primary Examiner*—Mark Spisich
*Attorney, Agent, or Firm*—Sughrue, Mion, Zinn, Macpeak & Seas

[57] ABSTRACT

A toilet mop is provided with a disposable scrubbing pad which is detachably connected to a handle by a simple, inexpensive device such as a rubberband, whereby the scrub pad can be readily detached from the handle without the necessity of touching the scrubbing pad for disposal purposes. The scrub pad is formed of compressed fibrous material having a slot extending therein from one edge of the pad. A flat insert having a plurality of projections along opposite side edges thereof is disposed in the pad with the projections engaging the fibers to prevent withdrawal of the insert. The handle is provided with a flat portion which may be inserted into the slot in superimposed contact with the insert and the rubberband may be connected between the insert and a notch on the handle to hold the pad on the handle.

4 Claims, 2 Drawing Sheets

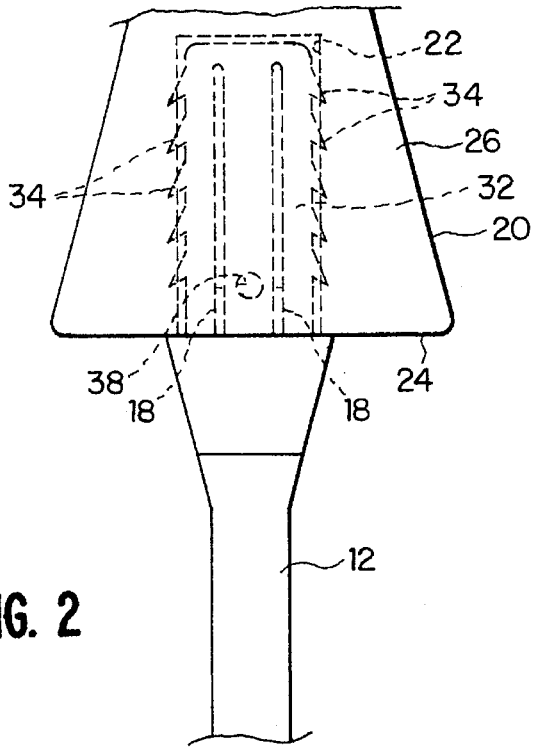
FIG. 2
FIG. 3
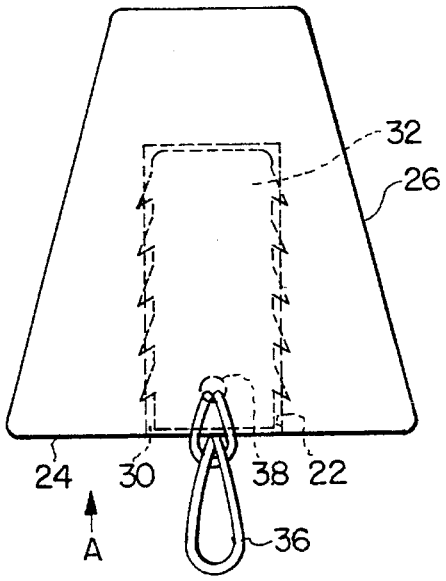
FIG. 4
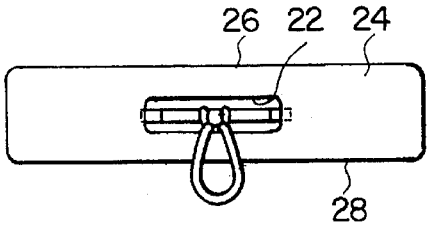

TOILET MOP

BACKGROUND OF THE INVENTION

The present invention is directed to a toilet mop and more specifically to a disposable scrubbing pad detachably connected to a handle by a securing device which permits quick detachment of the pad from the handle and disposal of the pad without touching the pad.

A number of conventional toilet mops are constructed of a handle and a scrubbing portion which are permanently connected together as a single piece. Such a toilet mop, however, is generally used a number of times before disposal of the mop thereby necessitating the need to supply some sort of stand or container for holding the mop when it is not in use. Such an arrangement is considered by some to be unsanitary and could possibly lead to unpleasant odors due to the formation of mildew or the like. Furthermore, such a toilet mop is relatively expensive so as to preclude disposal of the mop after a single use.

Other types of disposable toilet mops involve the use of a scrubbing pad which is detachably connected to a handle. Such a scrubbing pad is relatively inexpensive and can be disposed of after a single use. However, it is generally necessary to handle the disposable scrub pad in order to detach it from the handle. Many people would find this to be distasteful and unsanitary.

Still other disposable toilet mops provide a complicated connecting arrangement between a disposable pad and a handle. While such an arrangement permits disposal of the pad without touching the same, such disposable toilet mops are generally quite expensive due to the higher costs of the intricate detachable connection.

SUMMARY OF THE INVENTION

The present invention provides a new and improved toilet mop comprised of a disposable scrubbing pad detachably connected to a handle by means of a simple, inexpensive device which permits detachment of the scrub pad and disposal of the same without the necessity of touching the scrubbing pad.

The present invention provides a new and improved toilet mop comprised of an elongated handle having a flat connector portion at one end and a notch intermediate opposite ends of the handle, a scrub pad comprised of compressed fibrous material having a slot extending therein from one edge of the pad, a flat insert having a plurality of projections along opposite side edges thereof disposed in said pad with said projections engaging said fibers to prevent withdrawal of said insert and elastic means detachably connected between said insert and said notch for holding said flat portion of said handle in superimposed engagement with said insert within said slot in said pad whereby upon detachment of said elastic means from said notch, said flat portion of said handle can be easily withdrawn from said slot thereby permitting disposal of said pad.

The above and other objects, features and advantages of the present invention will be more apparent and more readily appreciated from the following detailed description of preferred exemplary embodiment of the present invention, taken in connection with the accompanying drawings.

BRIEF DESCRIPTION OF THE DRAWINGS

FIG. 2 is a top plan view of the pad and handle as shown in FIG. 1 with a portion of the handle broken away for illustration purposes.

FIG. 3 is a top plan view of the pad assembly as shown in FIG. 2, without the handle secured thereto.

FIG. 4 is an end elevational view of the pad assembly shown in FIG. 3 in the direction of the arrow A.

DETAILED DESCRIPTION OF THE INVENTION

Figure 1:
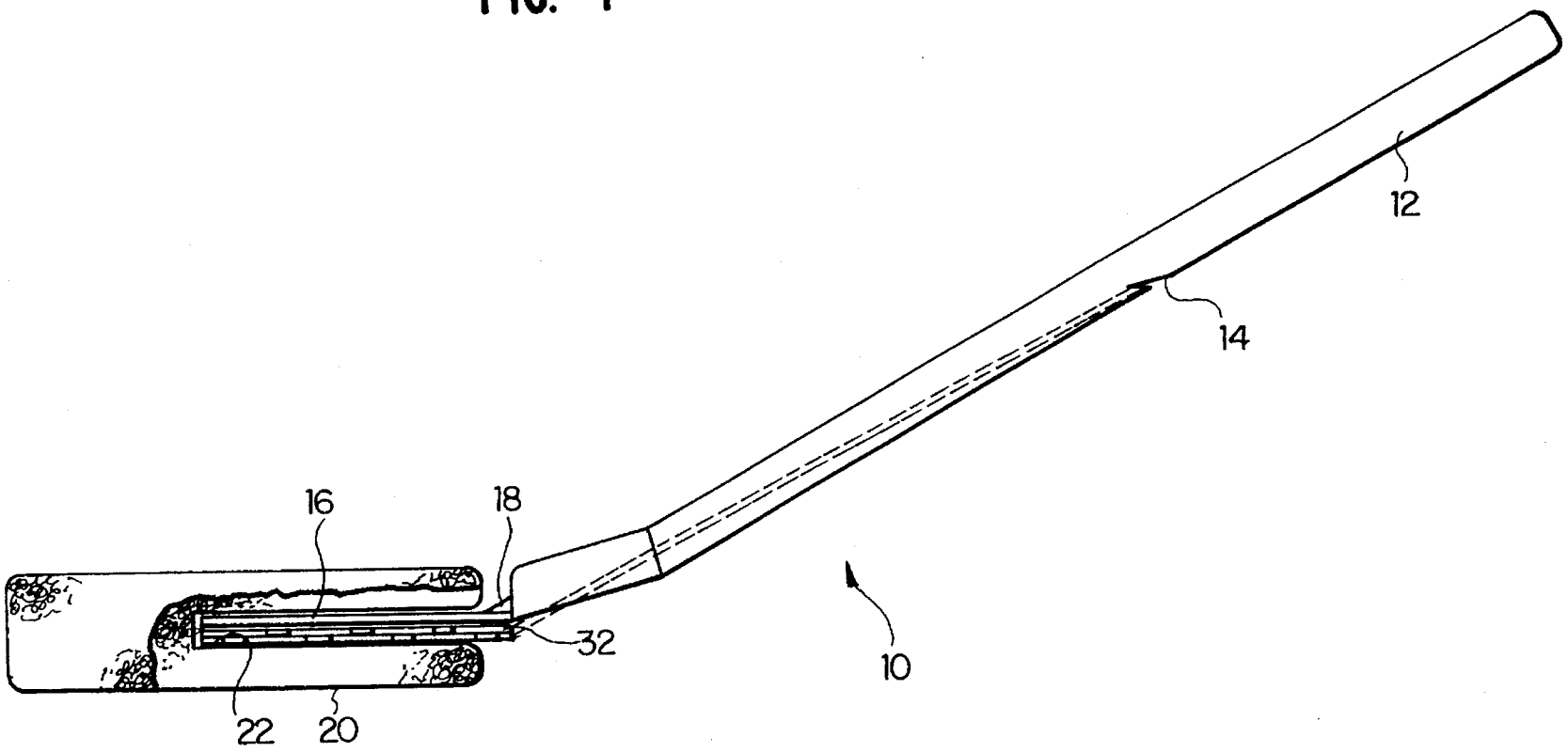
FIG. 1 is a side elevational view of the handle and disposable pad detachably connected together with the pad partially broken away to show the flat insert and flat portion of the handle within the slot in the pad.

The toilet mop 10 as shown in FIGS. 1 and 2 is comprised of an elongated handle 12 of molded plastic material having a notch 14 intermediate the opposite ends of the handle. One end of the handle is provided with a smooth, flat, substantially rectangular portion 16 which is disposed at an oblique angle relative to the elongated handle portion 12. Suitable reinforcing gussets 18 are formed at the intersection of the flat portion and the elongated handle portion to strengthen the connection therebetween. The entire handle may be of molded plastic material.

A disposable scrubbing pad 20 is comprised of fibrous material which has been compressed into the shape shown in FIGS. 3 and 4. The pad may be impregnated with a cleaning substance and the fibers may be of any suitable material, such as plastic or the like, which would prevent scratching of the surface which is being scrubbed. An elongated slot 22 is formed in the pad and extends inwardly into the pad from the end 24 of the pad. The slot is disposed substantially parallel to the main flat surfaces 26 and 28 of the pad in substantially equally spaced relation to said surfaces. The slot 22 may be formed at the time the pad 20 is formed by compressing the fibers about a smooth, flat plate (not shown) which is subsequently withdrawn from the pad through the opening 30 in the end 24 of the pad. Alternatively, if the fibers comprising the pad are of a suitable plastic material, a smooth, flat, heated element (not shown) could be inserted into the pad thereby effectively melting or burning the slot into the fibrous pad.

A flat, elongated substantially rectangular connecting plate 32, having dimensions substantially identical to those of the flat portion 16 of the handle, is provided with a plurality of angled projections 34 along opposite elongated edges thereof. The width of the connecting plate 32 is substantially equal to or slightly less than the width of the slot 22. The angled projections 34, however, have a length such that the distance between the tips of the projections 34 is greater than the width of the slot 22. The connecting plate 32 may be readily inserted into the slot 22 of the pad 20 without encountering substantial resistance. However, the connecting element 32 cannot be withdrawn from the slot due to the engagement of the angled projections 34 with the fibers of the pad 20. Thus, the connecting plate 32 effectively becomes a part of the disposable pad 20.

A conventional rubberband or any other comparable elastic element 36 is connected through an aperture 38 adjacent the end of the connecting plate 32 closest to the opening 30 in the pad 20. In order to connect the pad 20 to the handle 12, the flat portion 16 of the handle 12 is inserted into the slot 22 in flat superimposed contact with an upper surface of the connecting element 32, as shown in FIG. 1. The rubberband 36 may then be stretched upwardly along the handle 12 and engaged in the notch 14. Thus the resilient force of the rubberband will hold the flat portion 16 of the handle 12 within the slot 22 in engagement with the connecting member 32. Instead of a rubberband, an elastic member having a hook device at either end thereof could be used whereby the hooks would engage the notch 14 and the aperture 38, respectively.

With the pad assembled to the handle as shown in FIG. 1, the desired scrubbing operation can be carried out. When the scrubbing operation is completed and it is desired to dispose of the pad 20, it is only necessary to disconnect the elastic member 36 from the notch 14 in the handle 12. The pad 20 will then freely slide from the flat portion 16 of the handle 12 into a wastepaper basket or any other suitable means for disposal of the pad. The elastic element and the connecting element 32 would also be disposed of with the pad 20 unless the elastic member were of the type which could be readily disconnected from the connecting element 32 without having to touch the pad 20.

While the invention has been particularly shown and described with reference to preferred embodiments thereof, it will be understood by those in the art that the foregoing and other changes in form and details may be made therein without departing from the spirit and scope of the invention.

What is claimed is:

1. A toilet mop comprising an elongated handle having a flat portion at one end thereof and connector means located intermediate opposite ends of the handle, a scrub pad comprised of compressed fibrous material having a slot extending therein from one edge of the pad, a flat insert having a plurality of projections along opposite side edges thereof disposed in said pad with said projections engaging said fibers to prevent withdrawal of said insert and elastic means detachably connected between said insert and said connector means on said handle for holding said flat portion of said handle in superimposed engagement with said insert within said slot in said pad whereby upon detachment of said elastic means from said connector means, said flat portion of said handle can be easily withdrawn from said slot, thereby permitting disposal of said pad.

2. A toilet mop as set forth in claim 1, wherein said connector means is comprised of a notch disposed in said handle.

3. A toilet mop as set forth in claim 1, wherein said insert and said flat portion of said handle are comprised of substantially coextensive rectangular members.

4. A toilet mop as set forth in claim 1, wherein said handle is comprised of a substantially straight elongated portion disposed at an obtuse angle relative to said flat portion.

* * * * *